US011286728B2

(12) United States Patent
Allen et al.

(10) Patent No.: US 11,286,728 B2
(45) Date of Patent: Mar. 29, 2022

(54) HELICAL HARDBANDING

(71) Applicant: POSTLE INDUSTRIES, INC., Cleveland, OH (US)

(72) Inventors: James Allen, Cleveland, OH (US); Steve Stefancic, Cleveland, OH (US); Robert F. Miller, Cleveland, OH (US)

(73) Assignee: Postle Industries, Inc., Cleveland, OH (US)

( * ) Notice: Subject to any disclaimer, the term of this patent is extended or adjusted under 35 U.S.C. 154(b) by 0 days.

(21) Appl. No.: 16/574,658

(22) Filed: Sep. 18, 2019

(65) Prior Publication Data

US 2020/0095834 A1 Mar. 26, 2020

Related U.S. Application Data

(60) Provisional application No. 62/734,415, filed on Sep. 21, 2018.

(51) Int. Cl.
*E21B 17/10* (2006.01)
*E21B 17/22* (2006.01)

(52) U.S. Cl.
CPC ..... *E21B 17/1085* (2013.01); *E21B 17/22* (2013.01)

(58) Field of Classification Search
USPC ..... 166/380
See application file for complete search history.

(56) References Cited

U.S. PATENT DOCUMENTS 3,285,678 A 11/1966 Garrett et al.
3,989,554 A 11/1976 Wisler
4,228,339 A 10/1980 Scales et al.
4,243,727 A 1/1981 Wisler et al.
4,256,518 A 3/1981 Bolton et al.
4,285,410 A 8/1981 Samford
4,414,029 A 11/1983 Newman et al.
4,666,797 A 5/1987 Newman et al.
5,040,622 A * 8/1991 Winship ..... E21B 17/16 175/323
5,224,559 A 7/1993 Arnoldy et al.
5,697,460 A 12/1997 Stewart et al.
6,375,895 B1 4/2002 Daeman et al.
(Continued)

FOREIGN PATENT DOCUMENTS

WO 201102820 8/2011

OTHER PUBLICATIONS

US Search Authority, International Search Report and Written Opinion for corresponding application No. PCT/US2019/051683 (dated Dec. 3, 2019).

(Continued)

*Primary Examiner* — Taras P Bemko
(74) *Attorney, Agent, or Firm* — Ulmer & Berne LLP; Brian Turung

(57) ABSTRACT

A tubular hardbanded component that includes a body having an exterior surface, and a hardbanding treatment positioned at least partially about the exterior surface of said body. The hardbanding treatment includes a) a continuous band that forms one or more complete rotations about said exterior surface of said body, or b) a continuous band that forms less than one complete rotation about said exterior surface of said body. The continuous band is formed of a first hardbanding layer, a second hardbanding layer, and a third hardbanding layer.

28 Claims, 4 Drawing Sheets

(56) References Cited

U.S. PATENT DOCUMENTS

| | | | | |
|---|---|---|---|---|
| 7,243,717 | B2 | 7/2007 | Hall et al. | |
| 7,361,411 | B2 | 4/2008 | Daeman et al. | |
| 7,487,840 | B2 | 2/2009 | Gammage et al. | |
| 7,659,286 | B2 | 2/2010 | Dantzman et al. | |
| 8,602,113 | B2 | 12/2013 | Jin et al. | |
| 8,763,881 | B2 | 7/2014 | Keshavan et al. | |
| 8,783,344 | B2 | 7/2014 | Aung et al. | |
| 9,085,942 | B2 | 7/2015 | Hashem et al. | |
| 9,091,124 | B2 | 7/2015 | Hashem et al. | |
| 9,816,332 | B2 | 11/2017 | Hamre | |
| 2002/0054972 | A1 | 5/2002 | Charpentier et al. | |
| 2004/0206726 | A1 | 10/2004 | Daemen et al. | |
| 2011/0100720 | A1 | 5/2011 | Branagan et al. | |
| 2011/0220348 | A1* | 9/2011 | Jin | E21B 17/1085 166/244.1 |
| 2012/0193148 | A1 | 8/2012 | Overstreet et al. | |
| 2012/0196149 | A1* | 8/2012 | Fifield | B23K 35/3086 428/684 |
| 2015/0060050 | A1 | 3/2015 | Scott et al. | |
| 2015/0252631 | A1 | 9/2015 | Miller | |
| 2015/0306703 | A1* | 10/2015 | Hamre | E21B 17/1085 138/172 |
| 2016/0024621 | A1* | 1/2016 | Cheney | C22C 38/02 427/256 |
| 2017/0226807 | A1* | 8/2017 | Wyble | B23K 9/04 |

OTHER PUBLICATIONS

Stoody, "Hardfacing & High Alloy Product Selection Guide", www.esabna.com/shared/documents/itdownloads-2101a_stoody_hardfacing-highalloy_catalogue_8-15-17.pdf (Aug. 2017).

* cited by examiner

HELICAL HARDBANDING

The present disclosure claim priority on U.S. Provisional Application Ser. No. 62/734,415 filed Sep. 21, 2018, which is incorporated herein by reference.

The present disclosure relates generally to hardbanding on drill pipe, work string pipe, tubular components and the like, and more particularly to helical hardbanding on drill pipes. The helical hardbanding may be applied on the central regions of a tubular member (e.g., drill pipe, work string pipe, tubular components and the like).

BACKGROUND ON THE DISCLOSURE

For many years, oil and gas drill pipes have been protected at the tool joint of the drill pipe in order to reduce the amount of wear and abuse experienced when drilling through geological formations below the surface of the Earth. There have been various types of sacrificial products that have been installed at the tool joint of the drill pipe in order to protect the drill pipe from wear and abrasion. These sacrificial products are typically installed at the tool joint of the drill pipe because the tool joint is generally the widest location and experiences the most abuse.

As drilling technology advances, the rate and pace of drilling has increased due to economic factors and efficiency goals, thereby resulting in other areas of the drill pipe experiencing wear at an increasingly high level. As the drill pipe is being advanced into the ground in order to increase the rate of drilling, the deflection in the drill pipe is increasing and the central region of the drill pipe is encountering more contact with the surrounding geological formation. Also, the path of drilling (well profile) is becoming more complicated and encompasses more turns, which also creates opportunity for more contact between the central region of the drill pipe and the geology of the ground formation. For example, FIG. 2 illustrates four examples of deviated wells compared to a vertical well (i.e., a well descending along the vertical axis).

Products have been introduced into the drill pipe market to protect central regions of the pipe between tool joints. These products have included coatings that are applied to the mid-section of the drill pipe along with separate wear components that have been installed at some location along the length of the drill pipe. However, these products are expensive, have durability concerns, and can adversely affect the flow of fluids about the drill pipe.

In view of the prior art, there remains a need for less expensive components and methods for providing protection to the central regions of drill pipes that are more durable and which do not adversely affect the flow of fluids about the pipe.

SUMMARY OF THE DISCLOSURE

The present disclosure is directed to a tubular component (e.g., a drill pipe, work string pipe, etc.) with one or more hardbanding treatments on an external surface of the tubular component. For tubular components such a pipe that is used in downhole operations, the length of the tubular component is typically 20-50 ft. in length. As can be appreciated, the one or more hardbanding treatments can be applied to the exterior surface of other downhole tools such as, but not limited to, stabilizers, drill collars, jarring tool, drillings jars, centralizers, heavy weight drill pipe, etc.

One or more or all of the hardbanding treatments have a helical or spiral shape. The hardbanding treatment is used to provide 1) enhanced durability to the central region of the tubular component at potentially lower costs, 2) enhanced strength and/or rigidity of the central region of the tubular component to reduce the amount of bending or flexing of the tubular component during the insertion and/or removal of the tubular component into/from a wellbore, and/or 3) improved fluid and debris flow about the central region of the tubular component. The hardbanding treatment may be applied to a new or used tubular component.

In one non-limiting aspect of the disclosure, each of the hardbanding treatments are located on the body of the tubular component. As defined herein, for a tubular component that includes a box and threaded pin member, the body is the portion of the tubular member that is located between the box and threaded pin member. As such, one end of the body of the tubular member is connected to the threaded pin and the opposite end of the body of the tubular member is connected to the box. Generally, the box and threaded pin member have a diameter that is greater than a diameter of the body end that is connected to the box or threaded pin. The length of the body that is located between the box and threaded pin member is non-limiting. Each of the hardbanding treatments can be located only along a portion of the longitudinal length of the body of the tubular component or along the full length of the body of the tubular component. In one non-limiting arrangement, one or more of the hardbanding treatments is spaced from the box and/or threaded pin member of the tubular component. In another non-limiting arrangement, one or more of the hardbanding treatments is positioned along about 1-95% (and all values and ranges therebetween) of the longitudinal length of the body of the tubular component. In one non-limiting arrangement, one or more of the hardbanding treatments is positioned along about 2-50% of the longitudinal length of the body of the tubular component. In one non-limiting arrangement, one or more of the hardbanding treatments is positioned along about 2-30% of the longitudinal length of the body of the tubular component. In one non-limiting arrangement, one or more of the hardbanding treatments is positioned along about 2-25% of the longitudinal length of the body of the tubular component. In another non-limiting arrangement, one or more of the hardbanding treatments has a length of 0.4-80 ft. (and all values and ranges therebetween). In another non-limiting arrangement, one or more of the hardbanding treatments has a length of about 1-20 ft. In another non-limiting arrangement, one or more of the hardbanding treatments has a length of about 1-10 ft. In another non-limiting arrangement, one or more of the hardbanding treatments has a length of about 1-5 ft. In another non-limiting arrangement, one or more of the hardbanding treatments has a length of about 1-4 ft. In another non-limiting arrangement, one or more of the hardbanding treatments has a length of about 1-3 ft. In one specific configuration, the length of the hardbanding treatment is 20-28 in.

In another non-limiting aspect of the disclosure, one or more of the hardbanding treatments is located on or about the central region of the body of the tubular member, and generally located on a portion of all of the central region of the body. The central region of the body is ±20% of the longitudinal length of the body as measured from the central point on the body. For example, if the longitudinal length of the body was 20 ft., the central point along the body would be 10 ft. from each end of the body, and the central region would be ±20% of the longitudinal length of the body as measured from the central point on the body (which is 8 ft. in length—20% of 20 ft. extending from both directions from the central point), thus would be 6 ft. from each end of the body. In one non-limiting embodiment, at least a portion of one or more of the hardbanding treatments is positioned over the central point along the longitudinal length of the body. In another embodiment, one or more of the hardbanding treatments is positioned along the complete length of the central region of the body of the tubular member. In another embodiment, one or more of the hardbanding treatments is positioned along only a portion the length of the central region of the body of the tubular member. In another embodiment, one or more of the hardbanding treatments is fully located within the central region of the body of the tubular member. In another embodiment, only a portion of one or more of the hardbanding treatments is positioned within the central region of the body of the tubular member.

In another non-limiting aspect of the disclosure, the body of the tubular member can include one or more of the hardbanding treatments. When the body of the tubular member includes two or more hardbanding treatments, two or more of the hardbanding treatments can be spaced apart from one another along the longitudinal length of the body, or a portion of all of two or more of the hardbanding treatments that are located adjacent to one another can be spaced laterally apart from one another. When two or more of the hardbanding treatments are located adjacent to one another and spaced apart from one another, the lateral spacing between the adjacently positioned portions of the hardbanding treatments can be constant; however, this is not required.

In another non-limiting aspect of the disclosure, one or more of the hardbanding treatments located on the body of the tubular member forms a continuous band forming more than three complete rotations (i.e., more than 1080° of rotation) about the exterior surface of the body. In one non-limiting specific arrangement, one or more of the hardbanding treatments located on the body of the tubular member forms a continuous band forming 3.2-100 complete rotations (and all values and ranges therebetween) about the exterior surface of the body. It has been found that more than 3 complete rotations about the exterior surface of the body, and typically at least 3.05 complete rotations about the exterior surface of the body, provides the desired wear protection to the body of the tubular member. In one non-limiting specific arrangement, one or more of the hardbanding treatments located on the body of the tubular member forms a continuous band forming 3.05-20 complete rotations (and all values and ranges therebetween) about the exterior surface of the body. In another non-limiting specific arrangement, one or more of the hardbanding treatments located on the body of the tubular member forms a continuous band forming 3.05-10 complete rotations (and all values and ranges therebetween) about the exterior surface of the body. In another non-limiting specific arrangement, one or more of the hardbanding treatments located on the body of the tubular member forms a continuous band forming 3.06-5 complete rotations (and all values and ranges therebetween) about the exterior surface of the body. The spacing of the adjacently positioned portions of the continuous band is generally constant (e.g., step-over rate); however, this is not required. In one non-limiting embodiment, the spacing of the adjacently positioned portions of the continuous band at the point of each complete rotation about the body is about 0.5-60 in. (and all values and ranges therebetween). In one non-limiting specific arrangement, the spacing of the adjacently positioned portions of the continuous band at the point of each complete rotation about the body is about 1-30 in. In one non-limiting specific arrangement, the spacing of the adjacently positioned portions of the continuous band at the point of each complete rotation about the body is about 2-20 in. In one non-limiting configuration, the spacing between the bands of the continuous band is about 5-10 in., and typically 6-8 in.

In another non-limiting aspect of the disclosure, one or more of the hardbanding treatments located on the body of the tubular member forms a continuous band forming less than a complete full rotation (i.e., less than 360° of rotation) about the exterior surface of the body. In one non-limiting embodiment, the hardbanding treatment extends around the exterior of the body of the tubular member about 30-99% (and all values and ranges therebetween) of the circumference of the body. In one non-limiting example, the hardbanding treatment extends around the exterior of the body of the tubular member about 62.5-99% of the circumference of the body. In another non-limiting example, the hardbanding treatment extends around the exterior of the body of the tubular member about 70-90% of the circumference of the body. In one non-limiting example, the hardbanding treatment extends around the exterior of the body of the tubular member about 75-87.5% of the circumference of the body. In another non-limiting embodiment, a band of hardbanding treatment is formed of one or more discontinuous bands that comprise a single discontinuity. In another non-limiting embodiment, a band of hardbanding treatment is formed of one or more discontinuous bands that comprise a plurality of discontinuities. In another non-limiting embodiment, a band of hardbanding treatment is formed of one or more discontinuous bands that are circumferentially aligned. In another non-limiting embodiment, a band of hardbanding treatment is formed of one or more discontinuous bands that are not circumferentially aligned. The use of one or more of the hardbanding treatments forming less than a complete full rotation is generally used to repair and/or extend an existing hardbanding treatment so as to improve the wear resistance of the body of the tubular member; however, this is not required.

In another non-limiting aspect of the disclosure, one or more of the hardbanding treatments can be formed from one layer of hardbanding or can be formed from multiple layers of hardbanding. In one non-limiting embodiment, one or more of the hardbanding treatments has a width of at least 0.1 in. In another non-limiting embodiment, one or more of the hardbanding treatments has a width of up to about 12 in. In another non-limiting embodiment, one or more of the hardbanding treatments has a width of 0.1-10 in. (and all values and ranges therebetween. The width of one or more of the hardbanding treatments can be formed by a single layer of hardbanding, or from two or more layers of hardbanding that are positioned closely adjacent to one another (i.e., less than 0.5 in.) or are positioned in contact with one another. Generally, the width of each of the hardbanding treatments is formed from 1-10 layers of hardbanding (and all values and ranges therebetween) that are positioned closely adjacent to one another and/or are in positioned in contact with one another. In one non-limiting arrangement, the width of at least one of the hardbanding treatments is formed from a single layer of hardbanding. In another non-limiting arrangement, the width of at least one of the hardbanding treatments is formed from two layers of hardbanding that are positioned closely adjacent to one another or are positioned in contact with one another. In another non-limiting arrangement, the width of at least one of the hardbanding treatments is formed from three layers of hardbanding that are positioned closely adjacent to one another and/or are positioned in contact with one another. In another non-limiting arrangement, the width of at least one of the hardbanding treatments is formed from four layers of hardbanding that are positioned closely adjacent to one another and/or are positioned in contact with one another. In another non-limiting arrangement, the width of at least one of the hardbanding treatments is formed from five layers of hardbanding that are positioned closely adjacent to one another and/or are positioned in contact with one another. In another non-limiting arrangement, the width of at least one of the hardbanding treatments is formed from six layers of hardbanding that are positioned closely adjacent to one another and/or are positioned in contact with one another. In one non-limiting example, each layer of hardbanding has a width of about 0.25-2 in., and typically about 0.5-1 in. (e.g., 0.75 in., etc.), and has a height of about 0.1-1 in., and typically about 0.2-0.5 in. (e.g., 0.375 in., etc.); however, it can be appreciated that each layer of hardbanding can have other widths and/or heights. When two or more hardbanding layers are used to form a hardbanding treatment, generally each of the hardbanding layers has the same width and height; however, this is not required. For example, if the width of a hardbanding treatments is to be 3 in. and the width of each layer of hardbanding is about 0.75 in., then four layers of hardbanding that are positioned closely adjacent and/or in contact with an adjacently positioned hardbanding layer are used to form a hardbanding treatments having a width of 3 in. In a non-limiting embodiment, if the height of the hardbanding treatment is to be greater than the height of a hardbanding layer, two or more stacked hardbanding layers can be used to obtain the desired height of the hardbanding treatment. Generally, the number of stacked layers of hardbanding that are used to obtain a height of the hardbanding treatment is 1-10 hardbanding layers (and all values and ranges therebetween). For example, if the height of the hardbanding treatment is to be 0.75 in. and the height of each layer of hardbanding is about 0.375 in., then one layer of hardbanding is applied on top of a previous layer of hardbanding to create a hardbanding treatment of 0.75 in. in height. When the height of the hardbanding treatment is greater than a height of a single layer of hardbanding, thereby requiring two or more stacked layers of hardbanding, the stacking of the layers of hardbanding can be directly on top of one another, or a stacked layer of hardbanding is applied so as to overlap the two adjacently positioned edges (which edges may be in contact with one another or spaced apart less than 0.5 in.) of two previously applied layers of hardbanding. As such, in such a stacking arrangement, when the hardbanding treatment has a thickness of two hardbanding layers, then at least two bottom hardbanding layers and at least one top hardbanding layers are used to form the hardbanding treatment. Also, in such a stacking arrangement, when the hardbanding treatment has a thickness of three hardbanding layers, then at least three bottom hardbanding layers, at least two middle hardbanding layers, and at least one top hardbanding layer are used to form the hardbanding treatment.

In another non-limiting aspect of the disclosure, the maximum height of one or more of the hardbanding treatments is equal to or less than a differential height between the minimum outer diameter of the body of the tubular member and the maximum outer diameter of the box and/or threaded pin member. Generally, the box and/or threaded pin member on a tubular member has a maximum outer diameter that is greater than the minimum diameter, the average diameter, and/or the maximum diameter of the body of the tubular member. In many applications it has been found that, for purposes of desired wear and operation of the tubular member, the maximum height of the one or more hardbanding treatment should not exceed 1) the differential height between the minimum outer diameter of the body of the tubular member and the maximum outer diameter of the box, and/or threaded pin member, 2) the differential height between the average outer diameter of the body of the tubular member and the maximum outer diameter of the box and/or threaded pin member, and/or 3) the differential height between the maximum outer diameter of the body of the tubular member and the maximum outer diameter of the box, and/or threaded pin member.

As defined herein, hardbanding for a tubular member is a surface welding process for applying metal welding wire onto the surface of a tubular member. In such a process, an elongated metal wire is typically welded to a portion of the tubular component in order to build up and/or reinforce a portion of the body of the tubular member that is subjected to high frictional forces and abrasive forces. U.S. Pub. Nos. 2015/0252631 to Miller and 2018/0161909 to Miller et al. disclose various hardbanding/hardfacing compositions, welding processes, and welding parameters. These teachings may be used in conjunction with the compositions, systems, and methods of the present disclosure. Accordingly, U.S. Pub. Nos. 2015/0252631 and 2018/0161909 are incorporated by reference herein in their entireties.

The composition of the hardbanding metal can be the same or similar to the composition of the body of the tubular component; however, this is not required. For example, the hardbanding metal can have an as-welded hardness similar to the tubular component body hardness; however, this is not required. As can be appreciated, the chemical composition of such hardbanding material can be the same as or different from the tubular component body composition. The use of a welding material in which the as-welded hardness is similar to the tubular component body hardness will result in a wear life similar to the original tubular component body connection. However, using a more abrasion-resistant material such as, for example, Postle Industries' Duraband® NC, will result in a wear life greater than softer metals. Duraband® (when used) has a hardness of from about 58 to about 62 Rockwell C (RC), whereas the original tubular component body material (when used) has a hardness of from about 26 to about 32 RC. Using Duraband® has many advantages, such as being casing-friendly. "Casing-friendly" is a term used in the oilfield industry to denote how any given hardbanding acts upon the casing during drilling operations. For example, a non-casing-friendly material, such as tungsten carbide, causes excessive wear on a casing that lines the wellbore and can cause damage to the casing and eventually cause a blowout. "Casing" is defined as a pipe or tube used as a lining for a well. The tubular component body (when used without hardbanding) is not casing-friendly, and a similar weld deposit (when used) will typically also not be casing-friendly.

In another and/or alternative non-limiting aspect of the present disclosure, during the application of the hardbanding material on the tubular component body, the welding polarity is generally selected to be DC straight polarity (electrode negative); however, this is not required.

The hardbanding metal of the present disclosure can be welded to a surface under various types of gas (e.g., carbon dioxide, argon, oxygen-argon mixture, carbon dioxide-argon mixture, etc.), self-shielded (open arc) tubular wire, submerged arc electrode, etc. The hardbanding metal can be applied by use of a solid metal electrode, metal cored electrode, or flux cored electrode.

The hardbanding metal composition can include a combination of metals such as, but not limited to, carbon, manganese, silicon, chromium, niobium, molybdenum, iron, nickel, etc. The hardbanding metal can be formed by blending and/or mixing one or more components together, which can then be melted by a heat source (such as a furnace) and formed into a single, blended hardbanding metal material; however, this is not required. The hardbanding metal can be in the form of a wire, cored wire, etc. In one non-limiting configuration, the hardbanding metal is formed in a wire having a diameter of about 0.045 in.; however, other wire sizes can be used.

The hardbanding metal can be applied to a surface of a substrate (e.g., drill pipe, work string tubing, etc.) by welding; however, other or alternative techniques can be used. In one non-limiting configuration, the polarity is electrode negative (spray mode); however, the polarity can also or alternatively be electrode positive. The hardbanding metal to the tubular component is typically applied under a shielding gas such as, for example, argon and/or carbon dioxide; however, this is not required. As can be appreciated, other shielding gasses (when used) can be used.

In one non-limiting example, the hardbanding material can include a combination of carbon, manganese, silicon, chromium, iron, molybdenum, and/or niobium. In one non-limiting embodiment, the hardbanding material includes by weight: about 0.5% to about 2.5% carbon (and all values and ranges therebetween), about 0.01% to about 2% manganese (and all values and ranges therebetween), about 0.01% to about 2% silicon (and all values and ranges therebetween), about 4% to about 11% chromium (and all values and ranges therebetween), about 3% to about 9% niobium (and all values and ranges therebetween), and at least about 70% iron (e.g., the balance iron); and optionally include impurities and trace elements. The hardbanding material has a hardness of about 50-70 Rc (ISO 6508-1) (and all values and ranges therebetween), and typically about 55-65 Rc. One specific non-limiting hardbanding electrode that can be used to form such hardbanding metal is set forth in Table 1.

TABLE 1

(Postalloy Duraband ®)

| Component | General Range | Specific Formulation |
|---|---|---|
| Carbon | 1-2 wt. % | 1.2 wt. % |
| Manganese | 0.5-1.5 wt. % | 0.9 wt. % |
| Silicon | 0.5-1.5 wt. % | 0.9 wt. % |
| Chromium | 6-10 wt. % | 8 wt. % |
| Niobium | 4-8 wt. % | 6 wt. % |
| Iron | 75-88 wt. % | Balance |

The non-limiting welding parameters used to apply a hardbanding metal to the outer surface of a tubular using the electrode in Table 1 is set forth in Table 2 by a CMT process:

TABLE 2

| | | |
|---|---|---|
| Wire Size | 0.045 in. | 0.025-0.4 in. (all values/ranges therebetween) |
| Polarity | Electrode Negative | |
| Shielding Gas | 100% $CO_2$ | 0-100 vol. % $CO_2$, and 0-100 vol. % Ar (all values/ranges therebetween) |
| Amperage | 152 | 140-380 (all values/ranges therebetween) |
| Voltage | 19.3 | 15-35 (all values/ranges therebetween) |
| Torch Angle | 18° | 10-25° (all values/ranges therebetween) |

TABLE 2-continued

| | | |
|---|---|---|
| Torch Offset | ⅞ in. | 0.7-1.6 in. (all values/ranges therebetween) |
| Stickout | ½ in. | 0.4-1.5 in. (all values/ranges therebetween) |
| Oscillation | ⅝ in. | 0.25-2 in. (all values/ranges therebetween) |
| Oscillation Count | 70/min | 40-120/min. (all values/ranges therebetween) |
| Rotation speed | 100 seconds per revolution | 1-200 seconds per revolution (all values/ranges therebetween) |
| Preheat Temperature | 200° F. | 0-300° F. (all values/ranges therebetween) |
| Interpass Temperature | 430° F. | 400-850° F. (all values/ranges therebetween) |
| Number of full rotations of hardbanding | 3.0625 | 3.05-100 (all values/ranges therebetween) |
| Step-over rate of hardbanding | 7 in. | 3-20 in. (all values/ranges therebetween) |
| Pipe OD | 4 in. | 2-20 in. (all values/ranges therebetween) |
| Maximum hardbanding width | 2.5 in. | 0.4-8 in. (all values/ranges therebetween) |
| Profile of hardbanding layers | Flat | Non-limiting |

During the application of the hardbanding metal to the exterior surface of the tubular component body, the tubular component body can be rotated about its longitudinal axis; however, this is not required.

In one non-limiting object of the present disclosure, there is the provision of a tubular component with one or more hardbanding treatments on an external surface of the tubular component.

In another and/or alternative non-limiting object of the present disclosure, there is the provision of a tubular component with one or more hardbanding treatments wherein at least one of the hardbanding treatments has a helical or spiral shape.

In another and/or alternative non-limiting object of the present disclosure, there is the provision of a tubular component with one or more hardbanding treatments used to provide 1) enhanced durability to the central region of the tubular component at potentially lower costs, 2) enhanced strength and/or rigidity of the central region of the tubular component to reduce the amount of bending or flexing of the tubular component during the insertion and/or removal of the tubular component into/from a wellbore, and/or 3) improved fluid and debris flow about the central region of the tubular component.

In another and/or alternative non-limiting object of the present disclosure, there is the provision of a tubular component with one or more hardbanding treatments located on the body of the tubular component.

In another and/or alternative non-limiting object of the present disclosure, there is the provision of a tubular component with one or more hardbanding treatments positioned along about 1-95% of the longitudinal length of the body of the tubular member.

In another and/or alternative non-limiting object of the present disclosure, there is the provision of a tubular component with one or more hardbanding treatments having a length of 0.4-80 ft.

In another and/or alternative non-limiting object of the present disclosure, there is the provision of a tubular component with one or more hardbanding treatments located on or about the central region of the body of the tubular member.

In another and/or alternative non-limiting object of the present disclosure, there is the provision of a tubular component with two or more hardbanding treatments spaced apart from one another along the longitudinal length of the body, or a portion of all of two or more of the hardbanding treatments located adjacent to one another spaced laterally apart from one another.

In another and/or alternative non-limiting object of the present disclosure, there is the provision of a tubular component with one or more hardbanding treatments forming more than three complete rotations about the exterior surface of the body.

In another and/or alternative non-limiting object of the present disclosure, there is the provision of a tubular component with one or more hardbanding treatments wherein the spacing of the adjacently positioned portions of the continuous band of the hardbanding treatment is generally constant.

In another and/or alternative non-limiting object of the present disclosure, there is the provision of a tubular component with one or more hardbanding treatments wherein a continuous band of at least one of the hardbanding treatments has a spiral or helical shape, and a spacing of the band at the point of each complete rotation about the body of the tubular member is at least 0.5 in., and typically about 0.5-60 in.

In another and/or alternative non-limiting object of the present disclosure, there is the provision of a tubular component with one or more hardbanding treatments that form a continuous band that is less than a complete full rotation about the exterior surface of the body.

In another and/or alternative non-limiting object of the present disclosure, there is the provision of a tubular component with one or more hardbanding treatments formed from one layer of hardbanding or formed from multiple layers of hardbanding.

In another and/or alternative non-limiting object of the present disclosure, there is the provision of a tubular component with one or more hardbanding treatments having a width of at least 0.1 in. and a width of up to about 12 in.

In another and/or alternative non-limiting object of the present disclosure, there is the provision of a tubular component with one or more hardbanding treatments wherein the width of one or more of the hardbanding treatments is formed by a single layer of hardbanding, or from two or more layers of hardbanding that are positioned closely adjacent to one another or are positioned in contact with one another.

In another and/or alternative non-limiting object of the present disclosure, there is the provision of a tubular component with one or more hardbanding treatments wherein each layer of hardbanding has a width of about 0.25-2 in.

In another and/or alternative non-limiting object of the present disclosure, there is the provision of a tubular component with one or more hardbanding treatments wherein each layer of hardbanding has a height of about 0.1-1 in.

In another and/or alternative non-limiting object of the present disclosure, there is the provision of a tubular component with one or more hardbanding treatments wherein two or more hardbanding layers are used to form a hardbanding treatment and each of the hardbanding layers has generally the same width and/or height.

In another and/or alternative non-limiting object of the present disclosure, there is the provision of a tubular component with one or more hardbanding treatments wherein the cross-sectional shape of the band of the hardbanding treatment is non-limiting.

In another and/or alternative non-limiting object of the present disclosure, there is the provision of a tubular component with one or more hardbanding treatments wherein the thickness, width, cross-sectional shape, and/or composition of each of the bands along the length of each of the bands can be constant or can vary.

In another and/or alternative non-limiting object of the present disclosure, there is the provision of a tubular component with one or more hardbanding treatments wherein the hardbanding treatment is formed of two or more hardbanding layers, the composition of each of the hardbanding layers can be the same or different.

In another and/or alternative non-limiting object of the present disclosure, there is the provision of a tubular component with one or more hardbanding treatments wherein all of the hardbanding layers used to form the hardbanding have the same composition.

In another and/or alternative non-limiting object of the present disclosure, there is the provision of a tubular component with one or more hardbanding treatments wherein the composition of the hardbanding layers used to form the hardbanding have different compositions and the hardbanding layers used to form the top of the hardbanding treatment have a hardness that is greater than a hardness of one or more of the hardbanding layers located below the top layer of hardbanding.

In another and/or alternative non-limiting object of the present disclosure, there is the provision of a tubular component with one or more hardbanding treatments wherein the stacking of layers of hardbanding, when required, can be directly on top of one another, or a stacked layer of hardbanding is applied so as to overlap the edge of two previously applied layers of hardbanding.

In another and/or alternative non-limiting object of the present disclosure, there is the provision of a tubular component with one or more hardbanding treatments wherein the maximum height of one or more of the hardbanding treatments is equal to or less than a differential height between the minimum outer diameter of the body of the tubular member and the maximum outer diameter of the box and/or threaded pin member.

In another and/or alternative non-limiting object of the present disclosure, there is the provision of a tubular component with one or more hardbanding treatments wherein the composition of the hardbanding metal can be the same or similar to the composition of the body of the tubular component.

In another and/or alternative non-limiting object of the present disclosure, there is the provision of a tubular component with one or more hardbanding treatments wherein during the application of the hardbanding material on the tubular component body, the welding polarity is generally selected to be DC straight polarity (electrode negative); however, this is not required.

In another and/or alternative non-limiting object of the present disclosure, there is the provision of a tubular component with one or more hardbanding treatments wherein hardbanding metal can be welded to a surface by use of a solid wire, self-shielded tubular wire, submerged arc electrode, etc.

In another and/or alternative non-limiting object of the present disclosure, there is the provision of a tubular component with one or more hardbanding treatments wherein the hardbanding metal can be applied by use of a solid metal electrode, metal cored electrode, or flux cored electrode.

In another and/or alternative non-limiting object of the present disclosure, there is the provision of a tubular component with one or more hardbanding treatments wherein the hardbanding metal composition can include a combination of metals such as, but not limited to, carbon, manganese, silicon, chromium, niobium, molybdenum, iron, nickel, etc.

In another and/or alternative non-limiting object of the present disclosure, there is the provision of a tubular component with one or more hardbanding treatments wherein the hardbanding metal can be applied to a surface of the tubular member by welding; however, other or alternative techniques can be used.

In another and/or alternative non-limiting object of the present disclosure, there is the provision of a tubular component with one or more hardbanding treatments wherein during the application of the hardbanding metal to the exterior surface of the tubular component, the tubular component can be rotated about its longitudinal axis; however, this is not required.

In another and/or alternative non-limiting object of the present disclosure, there is the provision of a tubular hardbanded component comprising: 1) a body having an exterior surface, the exterior surface having a circumference; 2) a box secured to a first end of the body and/or a threaded pin member connected to a second end of the body, the box having a maximum outer diameter, the threaded pin member having a maximum outer diameter, a minimum outer diameter of the body is less than the maximum outer diameter of the box and/or threaded pin; and, 3) a hardbanding treatment positioned at least partially about the exterior surface of the body, the hardbanding treatment is a) a continuous band that forms more than three complete rotations about the exterior surface of the body, or b) a continuous band that forms less than one complete rotation about the exterior surface of the body.

In another and/or alternative non-limiting object of the present disclosure, there is the provision of a tubular hardbanded component wherein the hardbanding treatment is spaced from the box and/or the threaded pin member.

In another and/or alternative non-limiting object of the present disclosure, there is the provision of a tubular hardbanded component wherein at least a portion of the hardbanding treatment is positioned about a central region of the body, In another and/or alternative non-limiting object of the present disclosure, there is the provision of a tubular hardbanded component wherein the hardbanding treatment has a longitudinal length of 1-95% of a longitudinal length of the body.

In another and/or alternative non-limiting object of the present disclosure, there is the provision of a tubular hardbanded component wherein the body includes two or more of the hardbanding treatments.

In another and/or alternative non-limiting object of the present disclosure, there is the provision of a tubular hardbanded component wherein the hardbanding treatment is a continuous band that forms at least 3.05 complete rotations about the exterior surface of the body.

In another and/or alternative non-limiting object of the present disclosure, there is the provision of a tubular hardbanded component wherein the hardbanding treatment has a width formed by two or more adjacent hardbanding layers that are in contact with another or are positioned less than 0.5 in. from one another.

In another and/or alternative non-limiting object of the present disclosure, there is the provision of a tubular hardbanded component wherein the hardbanding treatment has a height formed by two or more hardbanding layers wherein one hardbanding layer is at least partially stacked on top of another hardbanding layer.

In another and/or alternative non-limiting object of the present disclosure, there is the provision of a tubular hardbanded component wherein a maximum height of the hardbanding treatment is less than or equal to 1) a differential height between a minimum outer diameter of the body of the tubular member and a maximum outer diameter of the box and/or the threaded pin member, 2) a differential height between an average outer diameter of the body of the tubular member and a maximum outer diameter of the box and/or the threaded pin member, and/or 3) a differential height between a maximum outer diameter of the body of the tubular member and a maximum outer diameter of the box and/or the threaded pin member.

In another and/or alternative non-limiting object of the present disclosure, there is the provision of a tubular hardbanded component wherein at least one of the hardbanding treatments is formed from at least first, second, and third hardbanding layers, the first and second hardbanding layers positioned adjacent to one another and in contact with one another or positioned less than 0.5 in. from one another, the third hardbanding layer positioned at least partially on top of the first and second hardbanding layers.

In another and/or alternative non-limiting object of the present disclosure, there is the provision of a tubular hardbanded component wherein the continuous band has a spiral or helical shape, a spacing of the band at the point of each complete rotation about the body is at least 0.5 in.

In another and/or alternative non-limiting object of the present disclosure, there is the provision of a tubular hardbanded component wherein the tubular component is a drill pipe.

In another and/or alternative non-limiting object of the present disclosure, there is the provision of a method for hardbanding a tubular component comprising: 1) providing a tubular component, the tubular component comprising a body having an exterior surface, and one or more of a box and threaded pin member, the exterior surface of the body having a circumference, a box secured to a first end of the body and/or a threaded pin member connected to a second end of the body, the box having a maximum outer diameter, the threaded pin member having a maximum outer diameter, a minimum outer diameter of the body is less than the maximum outer diameter of the box and/or threaded pin; and 2) applying one or more layers of hardbanding to the body to form a hardbanding treatment on the exterior surface of the body, the hardbanding treatment is a) a continuous band that forms more than three complete rotations about the exterior surface of the body, or b) a continuous band that forms less than one complete rotation about the exterior surface of the body.

In another and/or alternative non-limiting object of the present disclosure, there is the provision of a method for hardbanding a tubular component further including the step of at least partially cleaning the exterior surface of the body to remove oxides from the exterior surface prior to applying the one or more layers of hardbanding to the body.

In another and/or alternative non-limiting object of the present disclosure, there is the provision of a method for hardbanding a tubular component wherein the step of applying one or more layers of hardbanding to the body includes using a welding process and a wire or a cored wire.

In another and/or alternative non-limiting object of the present disclosure, there is the provision of a tubular hardbanded component wherein the welding process is DC straight polarity and using an electrode negative setting.

In another and/or alternative non-limiting object of the present disclosure, there is the provision of a tubular hardbanded component wherein the tubular component is a drill pipe.

These and other objects and advantages will become apparent to those skilled in the art upon reading and following the description taken together with the accompanying drawings.

BRIEF DESCRIPTION OF THE DRAWINGS

Reference may now be made to the drawings which illustrate various non-limiting embodiments that the disclosure may take in physical form and in certain parts and arrangement of parts wherein.

DETAILED DESCRIPTION OF THE NON-LIMITING EMBODIMENTS

Figure 1:
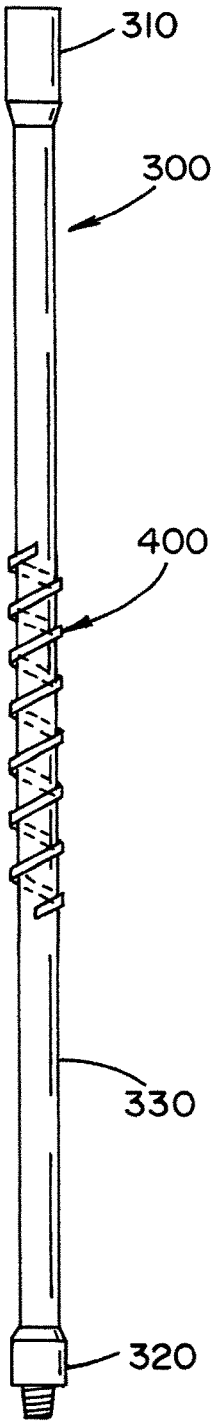
FIG. 1 is an illustration of a drill pipe that includes a single section of hardbanding treatment in the form of a helical or spiral configuration located on at least a portion of the central region of the body of the tubular component in accordance with some aspects of the present disclosure.

A more complete understanding of the articles/devices, processes, and components disclosed herein can be obtained by reference to the accompanying drawings. These figures are merely schematic representations based on convenience and the ease of demonstrating the present disclosure, and are, therefore, not intended to indicate relative size and dimensions of the devices or components thereof and/or to define or limit the scope of the exemplary embodiments.

Although specific terms are used in the following description for the sake of clarity, these terms are intended to refer only to the particular structure of the embodiments selected for illustration in the drawings and are not intended to define or limit the scope of the disclosure. In the drawings and the following description below, it is to be understood that like numeric designations refer to components of like function.

The singular forms "a," "an," and "the" include plural referents unless the context clearly dictates otherwise.

As used in the specification and in the claims, the term "comprising" may include the embodiments "consisting of" and "consisting essentially of." The terms "comprise(s)," "include(s)," "having," "has," "can," "contain(s)," and variants thereof, as used herein, are intended to be open-ended transitional phrases, terms, or words that require the presence of the named ingredients/steps and permit the presence of other ingredients/steps. However, such description should be construed as also describing compositions or processes as "consisting of" and "consisting essentially of" the enumerated ingredients/steps, which allows the presence of only the named ingredients/steps, along with any unavoidable impurities that might result therefrom, and excludes other ingredients/steps.

Numerical values in the specification and claims of this application should be understood to include numerical values which are the same when reduced to the same number of significant figures and numerical values which differ from the stated value by less than the experimental error of conventional measurement technique of the type described in the present application to determine the value.

All ranges disclosed herein are inclusive of the recited endpoint and independently combinable (for example, the range of "from 2 grams to 10 grams" is inclusive of the endpoints, 2 grams and 10 grams, and all the intermediate values).

The terms "about" and "approximately" can be used to include any numerical value that can vary without changing the basic function of that value. When used with a range, "about" and "approximately" also disclose the range defined by the absolute values of the two endpoints, e.g. "about 2 to about 4" also discloses the range "from 2 to 4." Generally, the terms "about" and "approximately" may refer to plus or minus 10% of the indicated number.

Percentages of elements should be assumed to be percent by weight of the stated element, unless expressly stated otherwise.

While this invention is susceptible of embodiments in many different forms, there is shown in the drawings and described herein in detail specific embodiments with the understanding that the present disclosure is to be considered as an exemplification and is not intended to be limited to the embodiments illustrated.

It will be understood that like or analogous elements and/or components, referred to herein, may be identified throughout the drawings by like reference characters. In addition, it will be understood that the drawings are merely schematic representations of the invention, and some of the components may have been distorted from actual scale for purposes of pictorial clarity.

The present disclosure is directed to a helical hardbanding that can be applied at a central region (e.g., a region located between the joints of the tubular component) of a tubular component. The helical hardbanding is formulated and applied in a manner so as to provide high durability at low cost; however, this is not required. The weld patterns of the present disclosure are configured to prolong the wear and abrasion protection of tubular component during use in a well.

Figure 2:
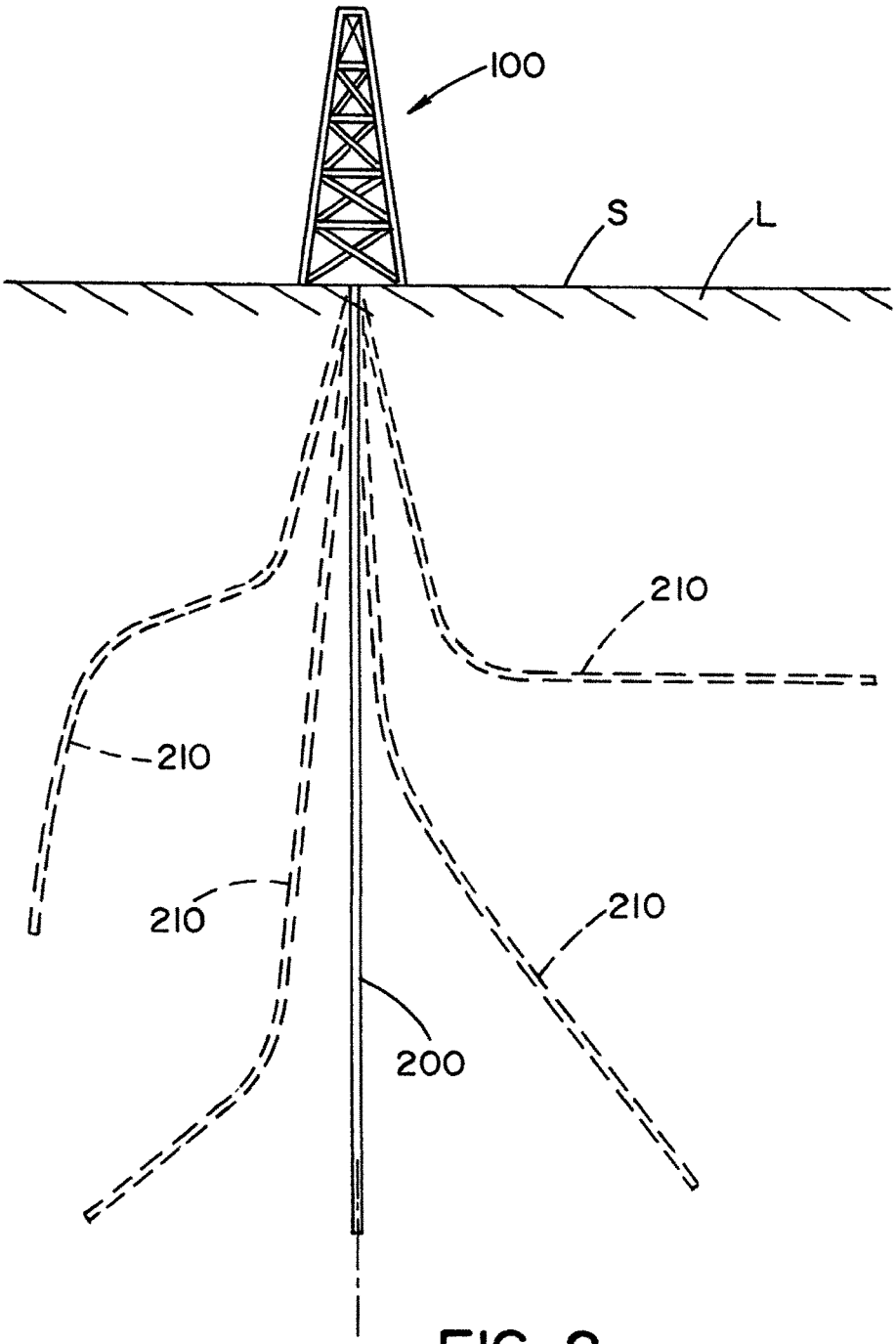
FIG. 2 is an illustration showing a plurality of prior art deviated wells as compared to a vertical well.

Referring now to FIG. 2, there is illustrated four examples of deviated wells compared to traditional vertical wells (i.e., a well descending along the vertical axis). A traditional well 100 is located on the top surface S of a land formation L. A wellbore 200 is formed under the well to extract hydrocarbon products from underground land formations. The dashed wellbore illustrates non-traditional wellbores 210. As the drill pipe is being advanced into the ground in order to increase the rate of drilling, the deflection in the drill pipe increases and the central region of the drill pipe encounters more contact with the surrounding geological formation. Also, as the path of drilling deviates from a vertical wellbore and encompasses more turns, the tubular member encounters more contact with the wall of the wellbore, thereby exposing the tubular member, and especially the body, of the tubular member to increased wear. In an effort to address this increased wear on the body on the tubular member, one or more hardbanding treatments are applied to body of the tubular member.

Figure 3:
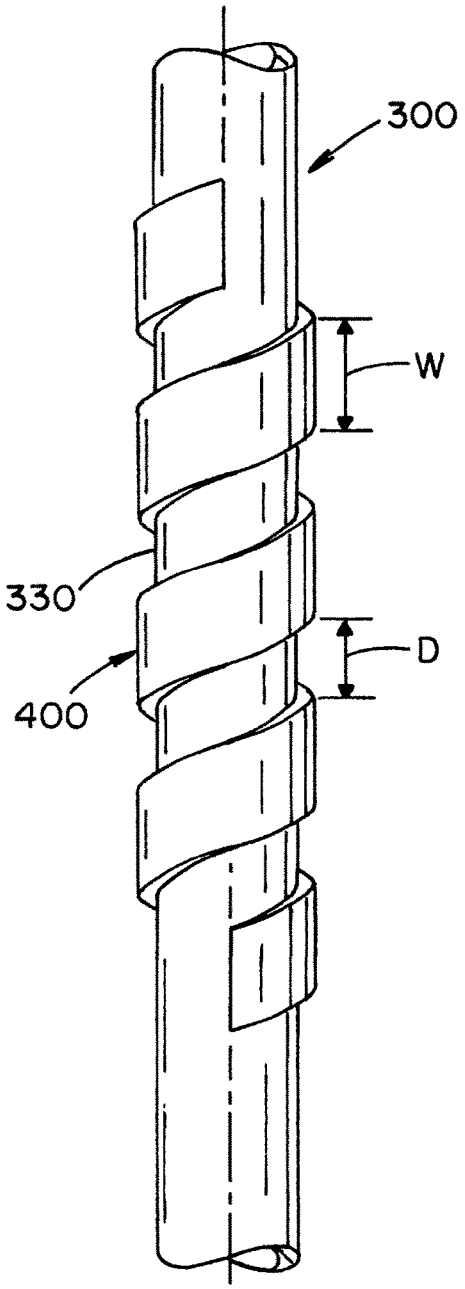
FIG. 3 is an illustration showing a non-limiting embodiment of a hardbanding treatment on the exterior surface of a portion of a body of a component in accordance with some aspects of the present disclosure.

Referring now to FIGS. 1 and 3, there are illustrated non-limiting embodiments of a tubular member 300 that includes a hardbanding treatment 400 in accordance with the present disclosure. The tubular member at one end includes a box 310 having a cavity (not shown) and at the other end is a threaded pin member 320. As illustrated in FIG. 2, the maximum outer diameter of the box and the threaded pin member is greater than the outer diameter of the body 330 of the tubular member.

The hardbanded treatment 400 has a spiral or helical shape that is disposed about a circumference of the exterior surface of the tubular body 330. The hardbanding treatment is illustrated as making more than three continuous "bands", or complete paths around the circumference of the tubular member 330. Specifically, in FIG. 1 there is illustrated a hardbanding treatment that has about seven continuous bands about the exterior surface of the body of the tubular member. FIG. 3 illustrates a hardbanding treatment that has about four continuous bands about the exterior surface of the body of the tubular member. The number of bands may any number greater than three (e.g., 4, 5, 6, 7, 8, 9, 10, or more bands). Additionally, the number of bands is not required to be an integer, but can also include some fraction of a band (e.g., 3.01-3.99 bands, 4.01-4.99 bands, 5.01-5.99 bands, etc.). The thickness, width, cross-sectional shape, and/or composition of each of the bands along the length of each of the bands can be constant or can vary.

Figure 4:
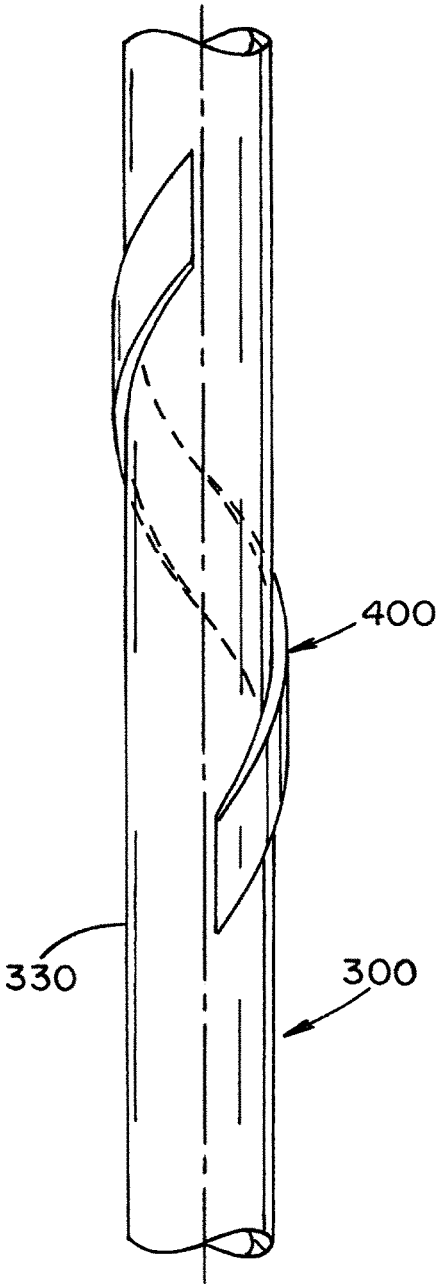
FIG. 4 is an illustration showing another non-limiting embodiment of a hardbanding treatment on the exterior surface of a portion of a body of a component in accordance with some aspects of the present disclosure.

FIG. 4 illustrates another non-limiting embodiment of a hardbanded treatment 400 on the tubular member 300 in accordance with the present disclosure. The tubular member 300 includes a tubular body 330 and a hardbanding treatment 400 that is helically or spirally disposed about an exterior surface of the tubular body 330. The hardbanding treatment is illustrated as not forming a complete band around the full circumference of the body 330. The partial band of the hardbanding treatment can extend around 20-99% (and all values and ranges therebetween) of the exterior surface of the body 330 (e.g., 62.5-99%, 70-90%, 75-87.5%, etc.). The thickness, width, cross-sectional shape, and/or composition of each of the bands along the length of each of the bands can be constant or can vary.

Figure 5:
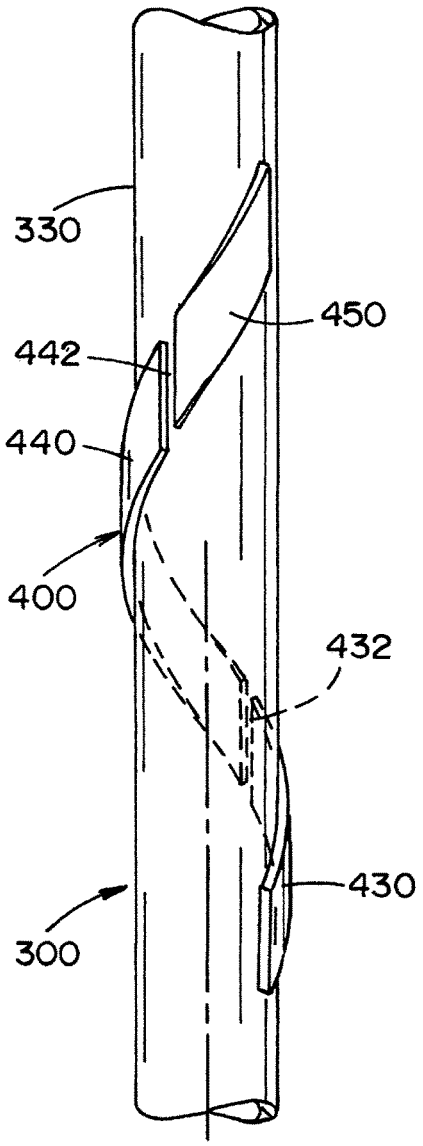
FIG. 5 is an illustration showing another non-limiting embodiment of a hardbanding treatment on the exterior surface of a portion of a body of a component in accordance with some aspects of the present disclosure.

FIG. 5 illustrates another non-limiting embodiment of a hardbanded treatment 400 on the tubular body 330 in accordance with the present disclosure. The tubular member 300 includes a tubular body 330 and a hardbanding treatment 400 that is helically or spirally disposed about an exterior surface of the tubular body 330. The hardbanding treatment is illustrated as not forming a complete band around the full circumference of the body 330. In particular, FIG. 5 illustrates a first hardbanding treatment section 430 that is separated from a second hardbanding treatment section 440 by a first gap 432 and the second hardbanding treatment section 440 that is separated from a third hardbanding treatment section 450 by a second gap 442. Although the depicted embodiment includes two gaps 432, 442, it is also contemplated that one gap or three or more gaps can be included on the tubular member 300. When a plurality of gaps are used, the gaps may be aligned or offset with respect to a horizontal axis of the body 330 and/or its circumference; however, this is not required. When a plurality of gaps are used, the distance between the gaps may be the same or different. Generally, the distance between the hardbanding treatment sections is about 0.25 in. to about 10 in. (and all values and ranges therebetween) (e.g., 0.25 in. to about 5 in., about 0.5 in. to about 3 in., about 0.5 in. to about 1 in., etc.).

As illustrated in FIG. 5, the multiple hardbanding treatment sections form a generally spiral- or helical-shaped system, and the system is illustrated as having less than one complete rotation about the body of the tubular member; however, it can be appreciated that the hardbanding treatment sections form a generally spiral- or helical-shaped system that is greater than one complete rotation about the body of the tubular member. Generally, each of the hardbanding treatment sections is less than a complete rotation about the body of the tubular member (e.g., 5-95% of a complete rotation and all values and ranges therebetween). As can be appreciated, the number of hardbanding treatment sections on the body of the tubular member is non-limiting (e.g., 2, 3, 4, 5, 6, etc.).

The aspects of FIGS. 3-5 may be used individually or in any combination thereof.

The width W of the hardbanding treatment 400 is non-limiting. In general, the width of the hardbanding treatment is typically 0.5-6 in. (and all values and ranges therebetween) (e.g., 1 in., 2.5-3.5 in., about 3 in, etc.). The distance D between adjacent bands of the hardbanding treatment may be from about 0.5 in. to about 40 in. (and all values and ranges therebetween) (e.g., 1 in. to about 30 in., about 2 in. to about 24 in., about 2 in. to about 18 in, about 2 in. to about 2.5 in., about 2.25 in., etc.) The thickness or height H of the hardbanding treatment is generally at least 0.05 in. and typically about 0.5-2 in. (e.g., 0375, 0.75, etc.).

The cross-sectional shape of the band of the hardbanding treatment is non-limiting. As illustrated in FIG. 6A-D, the cross-sectional shape is illustrated as being generally rectangular, triangular or trapezoidal; however, other shapes can be used (e.g., oval, square, polygonal, etc.). The thickness, width, cross-sectional shape, and/or composition of each of the bands along the length of each of the bands can be constant or can vary. As illustrated in FIG. 3, the width of the hardbanding treatment is generally constant along the length of the band of the hardbanding treatment. Generally, the shape and thickness is also constant along the longitudinal length of the hardbanding treatment. When the hardbanding treatment is formed of two of more hardbanding layers, the composition of each of the hardbanding layers can be the same or different. In one non-limiting arrangement, all of the hardbanding layers used to form the hardbanding have the same composition. In another non-limiting arrangement, all of the hardbanding layers used to form the hardbanding have the same composition, and all of the hardbanding layers used to form the hardbanding have generally the same size and shape. In another non-limiting arrangement, the composition of the hardbanding layers used to form the hardbanding have a different composition and the hardbanding layers used to form the top of the hardbanding treatment have a hardness that is greater than a hardness of one or more of the hardbanding layers located below the top layer of hardbanding. In another non-limiting arrangement, the composition of the hardbanding layers used to form the hardbanding have a different composition and the hardbanding layers used to form the top of the hardbanding treatment have a hardness that is greater than a hardness of one or more of the hardbanding layers located below the top layer of hardbanding, and all of the hardbanding layers used to form the hardbanding have generally the same size and shape.

Figure 6A:
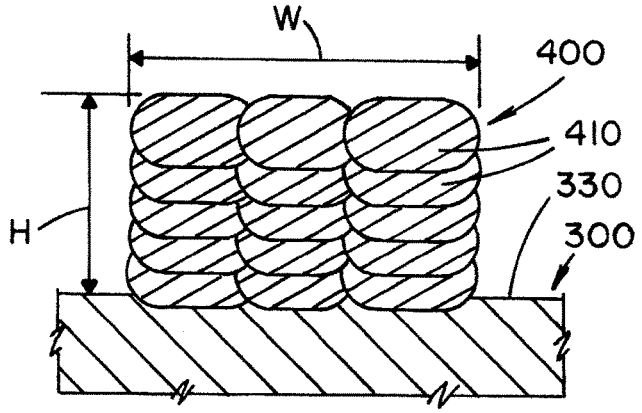
FIGS. 6A-D illustrate four non-limiting cross-sectional views of four different non-limiting hardbanding treatments on the exterior surface of a portion of a body of a component in accordance with some aspects of the present disclosure; and, FIGS. 7A-B illustrate the relative degree of deflection of the central region of the body of a tubular member that is absent a hardbanding treatment and includes a hardbanding treatment in accordance with some aspects of the present disclosure.

The hardbanding treatment can be formed by one or more hardbanding layers. As illustrated in FIG. 6A, there is illustrated a hardbanding treatment 400 that has a generally rectangular cross-sectional shape and is formed by twelve hardbanding layers 410. The hardbanding treatment is formed by four stacked layers high and four layers wide. The size and shape of each of the hardbanding layers 410 is generally about the same size and shape; however, this is not required. Each of the hardbanding layers that are stacked are stacked generally directly on top of one another. As such, each stacked hardbanding layer covers at least 60% and typically 75-100% of the below hardbanding layer. The adjacently positioned hardbanding layers are also illustrated as being connected together.

Figure 6B:
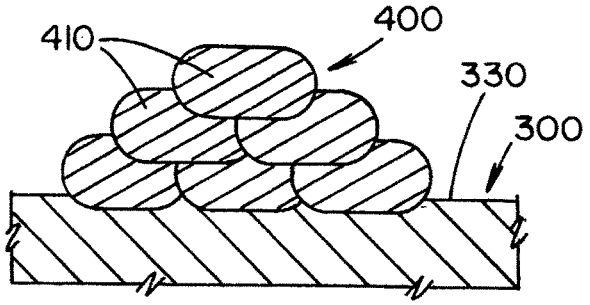

As illustrated in FIG. 6B, there is illustrated a hardbanding treatment 400 that has a generally triangular cross-sectional shape and is formed by six hardbanding layers, namely three bottom layers, two intermediate layers, and one top layer. The size and shape of each of the hardbanding layers 410 is generally about the same size and shape; however, this is not required. Each of the hardbanding layers that are stacked are stacked on top of two other hardbanding layers. As such, each stacked hardbanding layer covers about 20-75% and typically 30-60% of the below two hardbanding layers. The adjacently positioned hardbanding layers are also illustrated as being connected together.

Figure 6C:
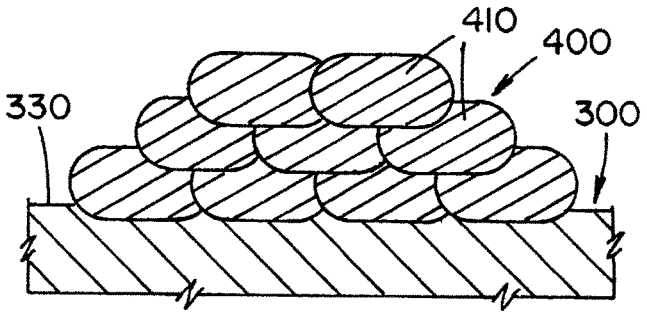

As illustrated in FIG. 6C, there is illustrated a hardbanding treatment 400 that has a generally trapezoidal cross-sectional shape and is formed by nine hardbanding layers, namely four bottom layers, three intermediate layers, and two top layers. The size and shape of each of the hardbanding layers 410 is generally about the same size and shape; however, this is not required. Each of the hardbanding layers that are stacked are stacked on top of two other hardbanding layers. As such, each stacked hardbanding layer covers about 20-75% and typically 30-60% of the below two hardbanding layers. The adjacently positioned hardbanding layers are also illustrated as being connected together.

Figure 6D:
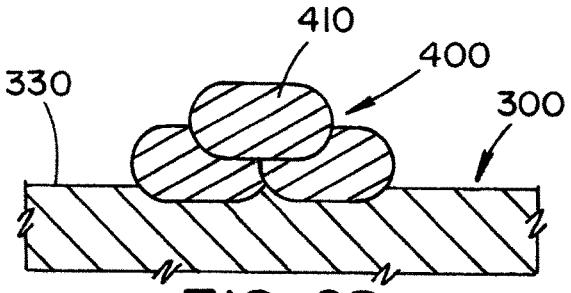

As illustrated in FIG. 6D, there is illustrated a hardbanding treatment 400 that has a generally triangular cross-sectional shape and is formed by three hardbanding layers, namely two bottom layers and one top layer. The size and shape of each of the hardbanding layers 410 is generally about the same size and shape; however, this is not required. The top hardbanding layer is stacked on top of two bottom hardbanding layers. As such, each stacked hardbanding layer covers about 20-75% and typically 30-60% of the below two hardbanding layers. The adjacently positioned hardbanding layers are also illustrated as being connected together.

When two or more hardbanding treatments are applied to the tubular member, the spacing between the bands of the two or more hardbanding treatments is non-limiting, and the length of the two or more bands of the hardbanding treatments can be the same or different.

Figure 7A:
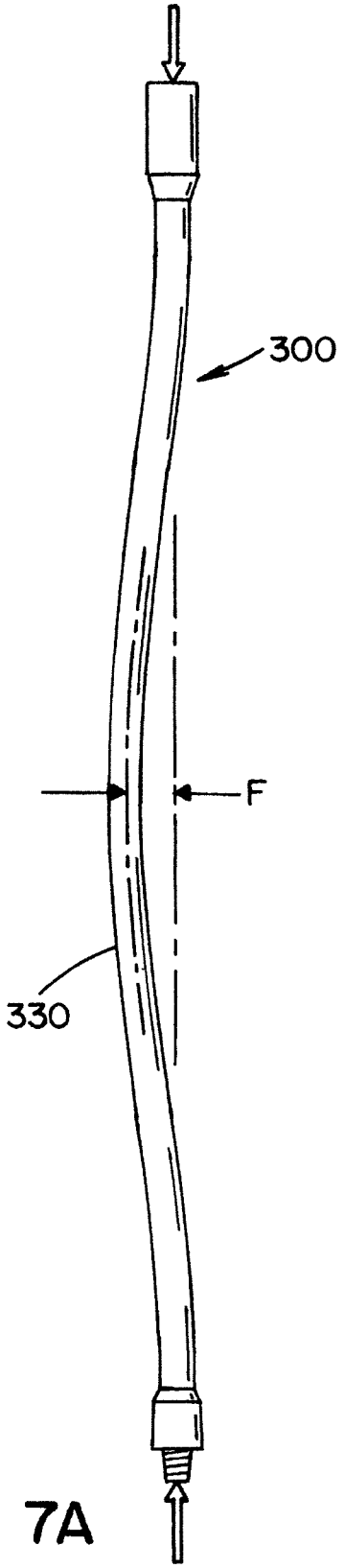
Figure 7B:
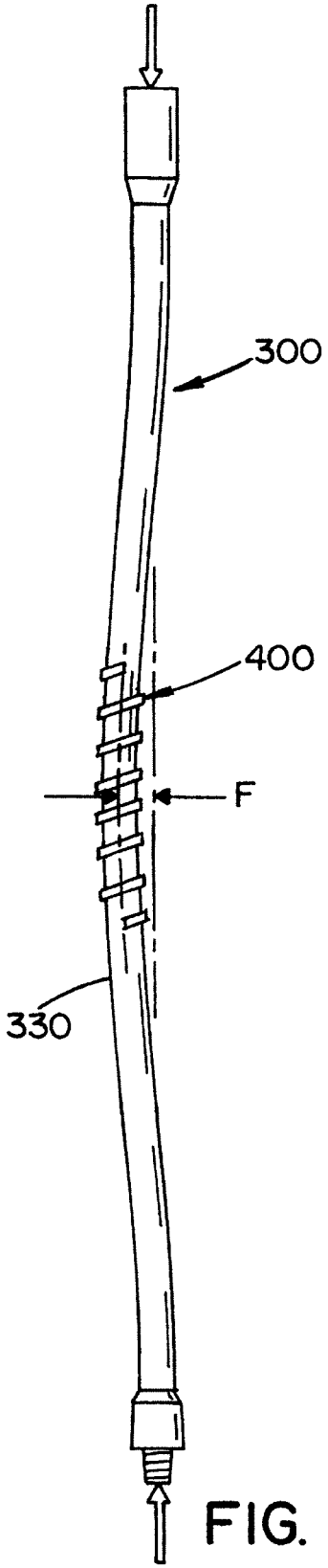

As illustrated in FIG. 7A-B, the inclusion of one or more hardbanding treatments 400 on the body 330 of the tubular member 300 results in a stiffer tubular member in the region that includes the hardbanding treatment, resulting in reduced amount of deflection of the tubular member when a force (as indicated by the force arrows) are applied to the ends of the tubular member. Such reduced deflection F of the tubular member that includes a hardbanding treatment in the central region of the body as compared to a tubular member that is absent hardbanding treatment, can result in 1) enhanced durability to the central region of the tubular component, 2) enhanced strength and/or rigidity of the central region of the tubular component to reduce the amount of bending or flexing of the tubular component during the insertion and/or removal of the tubular component into/from a wellbore, and/or 3) improved fluid and debris flow about the central region of the tubular component (e.g., auger effect from the spiral or helical hardbanding treatment can facilitate in moving fluid and/or debris past the central region of the tubular body).

The application of the one or more hardbanding layers that are used to form each of the hardbanding treatments on a body on the tubular member can be formed by use of a welding process with a lower heat input to the metal of the tubular component so that the body of the tubular component is not damaged during the application of the hardbanding. The helical or spiral hardbanding application used to form each of the hardbanding layers reduces the concentration of heat input to the body of the tubular component during the welding process. Also, the hardbanding process can actually have beneficial results to the properties of the tubular component by increasing the tensile strength, yield strength and, possibly, the fatigue resistance of the tubular component.

The helical or spiral pattern of the weld that is used to form each of the hardbanding layers can be used to allow for the uninterrupted flow of material about the exterior of the tubular member when used in the well, while also enhancing the wear resistance of the central region of the tubular member during use in the well.

The hardbanding metal composition for each of the hardbanding layers used to form the hardbanding treatment can be deposited by any suitable welding means and methods such as, but not limited to, open arc, gas or flux shielded, etc. The welding electrode that is used to form the hardbanding layer can be a solid wire, cored electrode, coated electrode, or coated cored electrode. When the welding electrode is a coated and/or cored electrode, the coating and/or fill material in the core can include alloying agents, fluxing agents, slag agents, gas generating agents, etc. The welding electrode can be a self-shielding electrode and/or be used in the presence of a shielding gas. As such, the hardbanding metal can be applied by a variety of processes such as, but not limited to, submerged arc welding, shielded metal arc welding, flux-cored arc welding, plasma arc welding, gas metal arc welding, cold metal transfer, gas tungsten arc welding, or cold metal transfer welding.

The hardbanding metal can be, but is not limited to, Postalloy® Duraband® NC, whose properties generally equal or exceed the original hardness and strength properties of the original upset properties of the body of the tubular component.

The composition of the hardbanding metal can be the same or similar to the composition of the body of the tubular component; however, this is not required. For example, the hardbanding metal can have an as-welded hardness similar to tubular component body hardness; however, this is not required. As can be appreciated, the chemical composition of such hardbanding material can be the same as or different from the tubular component body composition.

During the application of the hardbanding material on the tubular component body, the welding polarity is generally selected to be DC straight polarity (electrode negative); however, this is not required. The hardbanding metal can be welded to a surface under various types of gas (e.g., carbon dioxide, argon, oxygen-argon mixture, carbon dioxide-argon mixture, etc.), self-shielded (open arc) tubular wire, submerged arc electrode, etc. The hardbanding metal can be applied by use of a solid metal electrode, metal cored electrode, or flux cored electrode. The hardbanding metal to the tubular component is typically applied under a shielding gas such as, for example, argon and/or carbon dioxide; however, this is not required.

During the application of the hardbanding metal to the exterior surface of the tubular component body, the tubular component body can be rotated about its longitudinal axis; however, this is not required.

Prior to applying the hardbanding metal to the exterior surface of the tubular member, the exterior surface can be cleaned to remove oxides and/or other debris from the exterior of the tubular member.

The application of the hardbanding treatment can be applied to tubular components that did not previously include hardbanding on the body of the tubular component, or can be applied to a tubular component that previously included hardbanding on the body of the tubular component. When the hardbanding treatment is applied to a tubular component that previously included hardbanding on the body of the tubular component, the hardbanding treatment can be applied on top of the preexisting hardbanding, or be positioned adjacent to the preexisting hardbanding. When the hardbanding treatment is applied adjacent to preexisting hardbanding, generally the hardbanding treatment is applied such that it is spaced from the preexisting hardbanding; however, this is not required. In one non-limiting method of application of hardbanding to a tubular component that previously included hardbanding on the body of the tubular component, the hardbanding treatment is not applied to the tubular component until a top layer of multi-layers of hardbanding has been worn off, or if at least 50% the thickness of a single layer of hardbanding has been worn off. When the hardbanding treatment is applied on existing hardbanding or applied adjacent to preexisting hardbanding, the thickness of the applied hardbanding treatment does not exceed 1) the differential height between the minimum outer diameter of the body of the tubular member and the maximum outer diameter of the box and/or threaded pin member, 2) the differential height between the average outer diameter of the body of the tubular member and the maximum outer diameter of the box and/or threaded pin member, and/or 3) the differential height between the maximum outer diameter of the body of the tubular member and the maximum outer diameter of the box and/or threaded pin member.

The foregoing description merely explains and illustrates the invention and the invention is not limited thereto except insofar as the appended claims are so limited, as those skilled in the art who have the disclosure before them will be able to make modifications without departing from the scope of the invention.

While considerable emphasis has been placed herein on the structures and configurations of the preferred embodiments of the invention, it will be appreciated that other embodiments, as well as modifications of the embodiments disclosed herein, can be made without departing from the principles of the invention. These and other modifications of the preferred embodiments, as well as other embodiments of the invention, will be obvious and suggested to those skilled in the art from the disclosure herein, whereby it is to be distinctly understood that the foregoing descriptive matter is to be interpreted merely as illustrative of the present invention and not as a limitation thereof.

What is claimed:

1. A tubular hardbanded component comprising:

a body having an exterior surface, said exterior surface having a circumference;

a box secured to a first end of said body and a threaded pin member connected to a second end of said body, said box having a maximum outer diameter, said threaded pin member having a maximum outer diameter, a minimum outer diameter of said body is less than said maximum outer diameter of said box, a minimum outer diameter of said body is less than said maximum outer diameter of said threaded pin member; and, a hardbanding treatment positioned at least partially about said exterior surface of said body and spaced from said box and said threaded pin member, said hardbanding treatment includes a) a first continuous helically-shaped band that forms one or more complete rotations about said exterior surface of said body, or b) a first continuous helically-shaped band that forms less than one complete rotation about said exterior surface of said body; said first continuous helically-shaped band is spaced from said box and said threaded pin member, said first continuous helically-shaped band has first and second side edges and first and second ends, said first and second side edges are spaced from one another, said first and second ends are spaced from one another, said first end is located closer to said threaded pin member than said second end; said first continuous helically-shaped band including a first hardbanding layer, a second hardbanding layer, and a third hardbanding layer, said first and second hardbanding layers are positioned adjacent to one another, at least a portion of each of said first and second hardbanding layers is located above said exterior surface of said body, a majority or all of said third hardbanding layer is positioned on a top surface of said first and second hardbanding layers, a majority or all of said third hardbanding layer is spaced from and is located above said exterior surface of said body, a majority or all of said top surface of said first and second hardbanding layers is located above said exterior surface of said body; said first continuous helically-shaped band has a width formed at least partially by said first and second hardbanding layers that are in contact with one another or are positioned less than 0.5 in. from one another; said first and second hardbanding layers each have a height greater than 50% of said height of each of said first and second hardbanding layers located above said exterior surface of said body.

2. The tubular hardbanded component as defined in claim 1, wherein at least a portion of said first continuous helically-shaped band is positioned about a central region of said body.

3. The tubular hardbanded component as defined in claim 1, wherein said first continuous helically-shaped band has a longitudinal length of 1-95% of a longitudinal length of said body.

4. The tubular hardbanded component as defined in claim 1, wherein said first continuous helically-shaped band forms at least 3.05 complete rotations about said exterior surface of said body.

5. The tubular hardbanded component as defined in claim 1, wherein a maximum height of said first continuous helically-shaped band that is located above said exterior surface of said body is less than 1) a differential height between a minimum outer diameter of said body of said tubular member and a maximum outer diameter of said box or said threaded pin member, 2) a differential height between an average outer diameter of said body of said tubular member and a maximum outer diameter of said box or said threaded pin member, and/or 3) a differential height between a maximum outer diameter of said body of said tubular member and a maximum outer diameter of said box or said threaded pin member, and wherein a top surface of said first continuous helically-shaped band is located below said maximum outer diameter of said box and said maximum outer diameter of said threaded pin member.

6. The tubular hardbanded component as defined in claim 1, wherein a combined height of said first, second, and third hardbanding layers is less than or equal to a differential height between a minimum outer diameter of said body of said tubular member and a maximum outer diameter of said box or said threaded pin member, and wherein a top surface of said third hardbanding layer is located below said maximum outer diameter of said box and said maximum outer diameter of said threaded pin member.

7. The tubular hardbanded component as defined in claim 1, wherein a spacing of said first continuous helically-shaped band at the point of each complete rotation about the body is at least 0.5 in.

8. The tubular component of claim 1, wherein said tubular component is a drill pipe.

9. A tubular hardbanded component comprising:

a body having an exterior surface, said exterior surface having a circumference;

a box secured to a first end of said body and a threaded pin member connected to a second end of said body, said box having a maximum outer diameter, said threaded pin member having a maximum outer diameter, a minimum outer diameter of said body is less than said maximum outer diameter of said box, a minimum outer diameter of said body is less than said maximum outer diameter of said threaded pin member; and, a hardbanding treatment positioned at least partially about said exterior surface of said body and spaced from said box and said threaded pin member, said hardbanding treatment includes a) a first continuous helically-shaped band that forms one or more complete rotations about said exterior surface of said body, or b) a first continuous helically-shaped band that forms less than one complete rotation about said exterior surface of said body; said first continuous helically-shaped band is spaced from said box and said threaded pin member, said first continuous helically-shaped band has first and second side edges and first and second ends, said first and second side edges are spaced from one another, said first and second ends are spaced from one another, said first end is located closer to said threaded pin member than said second end; said first continuous helically-shaped band including a first hardbanding layer, a second hardbanding layer, and a third hardbanding layer, said first and second hardbanding layers are positioned adjacent to one another, at least a portion of each of said first and second hardbanding layers is located above said exterior surface of said body, a majority or all of said third hardbanding layer is positioned on a top surface of said first and second hardbanding layers, a majority or all of said third hardbanding layer is spaced from and is located above said exterior surface of said body, a majority or all of said top surface of said first and second hardbanding layers is located above said exterior surface of said body; said body includes a second continuous helically-shaped band, said first and second continuous helically-shaped bands are spaced from one another, said second continuous helically-shaped band includes a first hardbanding layer, a second hardbanding layer, and a third hardbanding layer, said first and second hardbanding layers of said second continuous helically-shaped band are positioned adjacent to one another, a majority or all of said third hardbanding layer of said second continuous helically-shaped band is positioned on a top surface of said first and second hardbanding layers of said second continuous helically-shaped band, a majority or all of said third hardbanding layer of said second continuous helically-shaped band is spaced from and is located above said exterior surface of said body, a majority or all of said top surface of said first and second hardbanding layers of said second continuous helically-shaped band is located above said exterior surface of said body.

10. A method for hardbanding a tubular component comprising:

providing a tubular component, said tubular component comprising a body having an exterior surface, a box and threaded pin member, said exterior surface of said body having a circumference, a box secured to a first end of said body and a threaded pin member connected to a second end of said body, said box having a maximum outer diameter, said threaded pin member having a maximum outer diameter, a minimum outer diameter of said body is less than said maximum outer diameter of said box, a minimum outer diameter of said body is less than said maximum outer diameter of said threaded pin member;

applying a hardbanding treatment on said exterior surface of said body, said hardbanding treatment is spaced from said box and said threaded pin member, said applying said hardbanding treatment includes:

a) applying a first continuous helically-shaped band to said exterior of said body that forms one or more complete rotations about said exterior surface of said body, or b) applying a first continuous helically-shaped band to said exterior of said body that forms less than one complete rotation about said exterior surface of said body, and wherein said first continuous helically-shaped band is spaced from said box and said threaded pin member, wherein adjacent bands of said continuous helically-shaped band are spaced from one another, wherein said first continuous helically-shaped band has first and second side edges and first and second ends, said first and second side edges are spaced from one another, said first and second ends are spaced from one another, said first end is located closer to said threaded pin member than said second end, wherein said first continuous helically-shaped band includes a first hardbanding layer, a second hardbanding layer, and a third hardbanding layer, said first and second hardbanding layers are positioned adjacent to one another, at least a portion of said first and second hardbanding layers is located above said exterior surface of said body, a majority or all of said third hardbanding layer is positioned on a top surface of said first and second hardbanding layers, a majority or all of said third hardbanding layer is spaced from and is located above said exterior surface of said body, and wherein said first and second hardbanding layers are applied to said exterior of said body such that at least a portion of said first and second hardbanding layers is located above said exterior surface of said body, and a majority or all of said top surface of said first and second hardbanding layer is located above said exterior surface of said body, and wherein said first continuous helically-shaped band has a width formed at least partially by said first and second hardbanding layers that are in contact with one another or are positioned less than 0.5 in. from one another; said first and second hardbanding layers each have a height greater than 50% of said height of each of said first and second hardbanding layers is located above said exterior surface of said body.

11. The method as defined in claim 10, further including the step of at least partially cleaning said exterior surface of said body to remove oxides from said exterior surface prior to applying said first and second layers of hardbanding to said body.

12. The method as defined in claim 10, wherein said step of applying includes using a welding process and a wire or a cored wire.

13. The method as defined in claim 12, wherein said welding process is DC straight polarity and uses an electrode negative setting.

14. The method as defined in claim 10, wherein at least a portion of said first continuous helically-shaped band is positioned about a central region of said body.

15. The method as defined in claim 10, wherein said first continuous helically-shaped band has a longitudinal length of 1-95% of a longitudinal length of said body.

16. The method as defined in claim 10, wherein said first continuous helically-shaped band forms at least 3.05 complete rotations about said exterior surface of said body.

17. The method as defined in claim 10, wherein a maximum height of said first continuous helically-shaped band that is located above said exterior surface of said body is less than 1) a differential height between a minimum outer diameter of said body of said tubular member and a maximum outer diameter of said box or said threaded pin member, 2) a differential height between an average outer diameter of said body of said tubular member and a maximum outer diameter of said box or said threaded pin member, and/or 3) a differential height between a maximum outer diameter of said body of said tubular member and a maximum outer diameter of said box or said threaded pin member, and wherein a top surface of said first continuous helically-shaped band is located below said maximum outer diameter of said box and said maximum outer diameter of said threaded pin member.

18. The method as defined in claim 10, wherein a combined height of said first, second, and third hardbanding layers is less than or equal to a differential height between a minimum outer diameter of said body of said tubular member and a maximum outer diameter of said box or said threaded pin member, and wherein a top surface of said third hardbanding layer is located below said maximum outer diameter of said box and said maximum outer diameter of said threaded pin member.

19. The method as defined in claim 10, wherein a spacing of said first continuous helically-shaped band at the point of each complete rotation about the body is at least 0.5 in.

20. The method as defined in claim 10, wherein said tubular component is a drill pipe.

21. A method for hardbanding a tubular component comprising:

providing a tubular component, said tubular component comprising a body having an exterior surface, a box and threaded pin member, said exterior surface of said body having a circumference, a box secured to a first end of said body and a threaded pin member connected to a second end of said body, said box having a maximum outer diameter, said threaded pin member having a maximum outer diameter, a minimum outer diameter of said body is less than said maximum outer diameter of said box, a minimum outer diameter of said body is less than said maximum outer diameter of said threaded pin member;

applying a hardbanding treatment on said exterior surface of said body, said hardbanding treatment is spaced from said box and said threaded pin member, said applying said hardbanding treatment includes:

a) applying a first continuous helically-shaped band to said exterior of said body that forms one or more complete rotations about said exterior surface of said body, or b) applying a first continuous helically-shaped band to said exterior of said body that forms less than one complete rotation about said exterior surface of said body, and wherein said first continuous helically-shaped band is spaced from said box and said threaded pin member, wherein adjacent bands of said continuous helically-shaped band are spaced from one another, wherein said first continuous helically-shaped band has first and second side edges and first and second ends, said first and second side edges are spaced from one another, said first and second ends are spaced from one another, said first end is located closer to said threaded pin member than said second end, wherein said first continuous helically-shaped band includes a first hardbanding layer, a second hardbanding layer, and a third hardbanding layer, said first and second hardbanding layers are positioned adjacent to one another, at least a portion of said first and second hardbanding layers is located above said exterior surface of said body, a majority or all of said third hardbanding layer is positioned on a top surface of said first and second hardbanding layers, a majority or all of said third hardbanding layer is spaced from and is located above said exterior surface of said body, and wherein said first and second hardbanding layers are applied to said exterior of said body such that at least a portion of said first and second hardbanding layers is located above said exterior surface of said body, and a majority or all of said top surface of said first and second hardbanding layer is located above said exterior surface of said body; and wherein said body includes a second continuous helically-shaped band, said first and second continuous helically-shaped bands are spaced from one another, said second continuous helically-shaped band includes a first hardbanding layer, a second hardbanding layer, and a third hardbanding layer, said first and second hardbanding layers of said second continuous helically-shaped band are positioned adjacent to one another, at least a portion of said first and second hardbanding layers of said second continuous helically-shaped band is located above said exterior surface of said body, a majority or all of said third hardbanding layer of said second continuous helically-shaped band is positioned on a top surface of said first and second hardbanding layers of said second continuous helically-shaped band, a majority or all of said third hardbanding layer of said second continuous helically-shaped band is spaced from and located above said exterior surface of said body, a majority or all of a top surface of said first and second hardbanding layers of said second continuous helically-shaped band is located above said exterior surface of said body.

22. A tubular hardbanded component comprising:

a body having an exterior surface, said exterior surface having a circumference and a minimum outer diameter;

a box secured to a first end of said body and a threaded pin member connected to a second end of said body, said box having a maximum outer diameter, said threaded pin member having a maximum outer diameter, said minimum outer diameter of said body is less than said maximum outer diameter of said box, a minimum outer diameter of said body is less than said maximum outer diameter of said threaded pin member; and, a hardbanding treatment positioned partially about said exterior surface of said body and spaced from said box and said threaded pin member, said hardbanding treatment includes a continuous helically-shaped band that forms one or more complete rotations about said exterior surface of said body, said continuous helically-shaped band is spaced from said box and said threaded pin member, said continuous helically-shaped band including first and second side edges and first and second ends, said first and second side edges are spaced from one another, said first and second ends are spaced from one another, said first end is located closer to said threaded pin member than said second end, adjacent bands of said continuous helically-shaped band are spaced from one another, said continuous helically-shaped band including a first hardbanding layer, a second hardbanding layer, and a third hardbanding layer, said first and second hardbanding layers are positioned adjacent to one another, at least a portion of said first and second hardbanding layers is secured to said body, at least a portion of said first and second hardbanding layers is located above said exterior surface of said body, a majority or all of said third hardbanding layer is positioned on a top surface of said first and second hardbanding layers and a majority or all of said third hardbanding layer is spaced from and is located above said exterior surface of said body, said hardbanding treatment has a width formed at least partially by said first and second hardbanding layers that are in contact with one another or are positioned less than 0.5 in. from one another, said first and second hardbanding layers each have a height, greater than 50% of said height of said first and second hardbanding layers is located above said exterior surface of said body, a majority or all of a top surface of said first and second hardbanding layers is located above said exterior surface of said body, a maximum height of said hardbanding treatment that is located above said exterior surface of said body is less than 1) a differential height between a minimum outer diameter of said body of said tubular member and a maximum outer diameter of said box or said threaded pin member, 2) a differential height between an average outer diameter of said body of said tubular member and a maximum outer diameter of said box or said threaded pin member, and/or 3) a differential height between a maximum outer diameter of said body of said tubular member and a maximum outer diameter of said box or said threaded pin member, and wherein a top surface of said first continuous helically-shaped band is located below said maximum outer diameter of said box and said maximum outer diameter of said threaded pin member.

23. The tubular hardbanded component as defined in claim 22, wherein a combined height of said first, second, and third hardbanding layers is less than or equal to a differential height between a minimum outer diameter of said body of said tubular member and a maximum outer diameter of said box or said threaded pin member.

24. The tubular hardbanded component as defined in claim 23, wherein all of said third hardbanding layer is spaced from said exterior surface of said body, all of said third hardbanding layer is positioned on a top surface of said first and second hardbanding layers, all of said top surface of said first and second hardbanding layers is located above said exterior surface of said body.

25. The tubular hardbanded component as defined in claim 24, wherein said continuous helically-shaped band that forms more than one complete rotation about said exterior surface of said body.

26. The tubular hardbanded component as defined in claim 25, wherein said continuous helically-shaped band that forms more than three complete rotations about said exterior surface of said body.

27. The tubular hardbanded component as defined in claim 26, wherein said third hardbanding layer overlies at least 20% of said top surface of said first and second hardbanding layers.

28. A tubular hardbanded component comprising:

a body having an exterior surface, said exterior surface having a circumference and a minimum outer diameter;

a box secured to a first end of said body and a threaded pin member connected to a second end of said body, said box having a maximum outer diameter, said threaded pin member having a maximum outer diameter, said minimum outer diameter of said body is less than said maximum outer diameter of said box, a minimum outer diameter of said body is less than said maximum outer diameter of said threaded pin member; and, a hardbanding treatment positioned partially about said exterior surface of said body and spaced from said box and said threaded pin member, said hardbanding treatment includes a continuous helically-shaped band that forms more than one complete rotations about said exterior surface of said body, said continuous helically-shaped band is spaced from said box and said threaded pin member, said continuous helically-shaped band including first and second side edges and first and second ends, said first and second side edges are spaced from one another, said first and second ends are spaced from one another, said first end located closer to said threaded pin member than said second end, adjacent bands of said continuous helically-shaped band are spaced from one another, said continuous helically-shaped band including a first hardbanding layer and a second hardbanding layer, said first and second hardbanding layers are positioned adjacent to one another, at least a portion of said first and second hardbanding layers is connected to said body, at least a portion of said first and second hardbanding layers is located above said exterior surface of said body, a majority or all of a top surface of said first and second hardbanding layers is located above said exterior surface of said body, said continuous helically-shaped band has a width formed at least partially by said first and second hardbanding layers that are in contact with one another, said first and second hardbanding layers each have a height, greater than 50% of said height of said first and second hardbanding layers is located above said exterior surface of said body, a maximum height of said continuous helically-shaped band that is located above said exterior surface of said body is less than 1) a differential height between a minimum outer diameter of said body of said tubular member and a maximum outer diameter of said box or said threaded pin member, 2) a differential height between an average outer diameter of said body of said tubular member and a maximum outer diameter of said box or said threaded pin member, and/or 3) a differential height between a maximum outer diameter of said body of said tubular member and a maximum outer diameter of said box or said threaded pin member, and wherein a top surface of said first continuous helically-shaped band is located below said maximum outer diameter of said box and said maximum outer diameter of said threaded pin member.

* * * * *